US007674524B2

(12) United States Patent
Goda

(10) Patent No.: US 7,674,524 B2
(45) Date of Patent: Mar. 9, 2010

(54) THERMOADHESIVE CONJUGATE FIBER AND MANUFACTURING METHOD OF THE SAME

(75) Inventor: Hironori Goda, Matsuyama (JP)

(73) Assignee: Teijin Fibers Limited, Osaka (JP)

( * ) Notice: Subject to any disclaimer, the term of this patent is extended or adjusted under 35 U.S.C. 154(b) by 0 days.

(21) Appl. No.: 12/278,323

(22) PCT Filed: Feb. 2, 2007

(86) PCT No.: PCT/JP2007/052290

§ 371 (c)(1),
(2), (4) Date: Aug. 5, 2008

(87) PCT Pub. No.: WO2007/091662

PCT Pub. Date: Aug. 16, 2007

(65) Prior Publication Data

US 2009/0029165 A1 Jan. 29, 2009

(30) Foreign Application Priority Data

Feb. 6, 2006 (JP) ..... 2006-028314
Feb. 6, 2006 (JP) ..... 2006-028315

(51) Int. Cl.
*D02G 3/00* (2006.01)

(52) U.S. Cl. ..... 428/370; 428/373; 428/374; 264/172.15; 264/210.4; 264/210.5

(58) Field of Classification Search ..... 428/370, 428/373, 374; 264/172.15, 210.4, 210.5, 264/210.8
See application file for complete search history.

(56) References Cited

U.S. PATENT DOCUMENTS 4,269,888 A 5/1981 Ejima et al.
4,678,531 A * 7/1987 Metzger et al. ..... 156/250
5,162,074 A * 11/1992 Hills ..... 216/83
5,641,570 A * 6/1997 Blackwell ..... 428/370
5,652,057 A * 7/1997 Delker ..... 428/373
5,780,155 A 7/1998 Ishizawa et al.
5,948,529 A * 9/1999 Hastie ..... 428/373
6,296,933 B1 * 10/2001 Goda et al. ..... 428/364
6,689,461 B2 * 2/2004 Koyanagi et al. ..... 428/364
6,846,560 B2 * 1/2005 Koyanagi et al. ..... 428/370
6,982,118 B2 * 1/2006 Koyanagi et al. ..... 428/364

FOREIGN PATENT DOCUMENTS

EP 0 340 982 A2 11/1989
JP 49-75869 A 7/1974
JP 52-21419 A 2/1977
JP 57-167418 A 10/1982
JP 06-108310 4/1994
JP 2004-218183 8/2004
JP 2004-218183 A 8/2004

* cited by examiner

*Primary Examiner*—N. Edwards
(74) *Attorney, Agent, or Firm*—Sughrue Mion, PLLC

(57) ABSTRACT

A major object of the invention is to provide a thermoadhesive conjugate fiber with low heat shrinkability and high adhesion having low orientation and high elongation and having extremely satisfactory card-passing properties. The object of the invention can be achieved by a thermoadhesive conjugate fiber made of a fiber forming resin component and a crystalline thermoplastic resin having a melting point of at least 20° C. lower than that of the fiber forming resin component and having a breaking elongation of from 60 to 600%, a dry heat shrinkage percentage at 120° C. of from −10.0 to 5.0%, and more preferably a percentage of crimp/number of crimps of 0.8 or more; and a manufacturing method of a thermoadhesive conjugate fiber, which includes drawing an undrawn yarn of a conjugate fiber taken up at a spinning rate of from 150 to 1,800 m/min in a low draw ratio of from 0.5 to 1.3 times at a temperature higher than both a glass transition temperature of a major crystalline thermoplastic resin of the thermo-adhesive resin component and a glass transition temperature of the fiber forming resin component and simultaneously subjecting to a fixed-length heat treatment and subsequently subjecting to a heat treatment under no tension at a temperature of at least 5° C. higher than the temperature of the fixed-length heat treatment.

20 Claims, No Drawings

THERMOADHESIVE CONJUGATE FIBER AND MANUFACTURING METHOD OF THE SAME

BACKGROUND OF THE INVENTION

1. Field of the Invention

The present invention relates to a thermoadhesive conjugate fiber which is high in adhesive tenacity after thermal adhesion and extremely small in heat shrinkage after thermal adhesion and to a manufacturing method of the same. In more detail, the invention relates to a thermoadhesive conjugate fiber which despite of low orientation and high elongation, has a satisfactory crimp performance and is provided with satisfactory card-passing properties, high adhesion and low heat shrinkability and to a manufacturing method of the same.

2. Description of the Related Art

In general, a thermoadhesive conjugate fiber represented by core/sheath type thermoadhesive conjugate fibers made of a thermoadhesive resin component as a sheath and a fiber forming resin component as a core is used by a forming a fiber web by a card method, an airlaid method, a wet paper making method, or the like and then melting the thermoadhesive resin component to form fiber-to-fiber bonding. Namely, since an adhesive using an organic solvent as a solvent is not used, discharge of noxious substances is less. Also, since an improvement in production rate and a merit in cost reduction following this are large, thermoadhesive conjugate fibers have been widely used for fiber structures such as fiber cushion and bed mat and nonwoven fabric applications. Furthermore, for the purpose of aiming to improve nonwoven fabric tenacity and to improve production rate of nonwoven fabrics, it is investigated to improve low-temperature adhesion or adhesive strength of thermoadhesive conjugate fibers.

Patent Document 1 discloses a thermoadhesive conjugate fiber obtained by using a terpolymer composed of propylene, ethylene and butene-1 as a sheath component and crystalline polypropylene as a core component and conjugate spinning the both in a ratio of a sheath component weight to a core component weight of from 20/80 to 60/40, followed by drawing in a low draw ratio of less than 3.0 times. It is disclosed that the subject thermoadhesive conjugate fiber has high adhesive tenacity as compared with ones of the related art. However, since such a fiber is low in draw ratio, a uniform tension is not applied between single yarns, scattering in neck deformation is large, and fineness unevenness is generated. Furthermore, there was involved a drawback that heat shrinkage percentage and unevenness of heat shrinkage are large.

Patent Document 2 discloses a thermoadhesive conjugate fiber formed of a thermoadhesive resin component having an orientation index of not more than 25% and a fiber forming resin component having an orientation index of 40% or more by a high-speed spinning method. It is disclosed that the subject thermoadhesive conjugate fiber is strong in adhesion point strength, is molten at lower temperatures and is low in heat shrinkage percentage.

However, in such a fiber, orientation is relatively low; elongation is high; orientation by drawing is insufficient; and orientation crystallization proceeds in high-speed spinning. Accordingly, in a mechanical crimp-imparting method by a crimper with a stuffing box or the like, crimp which has been once imparted is recovered, and fiber-to-fiber entanglement is easy to become worse. Accordingly, the subject thermoadhesive conjugate fiber is poor in card-passing properties. That is, since the web is cut, it is impossible to increase a card-passing speed. Therefore, there was involved a problem that the volume of manufacture cannot be increased in manufacturing nonwoven fabrics. On the other hand, at the time of fiber manufacture, there is a method of strengthening crimp of fibers by performing heating prior to passing through a crimper. However, since the stiffness of fiber is low, the crimp is very fine. Accordingly, since fiber-to-fiber entanglement is excessively strong, the card-passing properties become rather deteriorated. As described above, in thermoadhesive conjugate fibers with low orientation and high elongation, there have not been proposed fibers with satisfactory card-passing properties so far.

Patent Document 1: JP-A-6-108310

Patent Document 2: JP-A-2004-218183

SUMMARY OF THE INVENTION

In view of the foregoing background of the related art, the invention has been made, and its object is to provide a thermoadhesive conjugate fiber having low orientation, high elongation, low heat shrinkability and high adhesion and having extremely satisfactory card-passing properties. Furthermore, another object thereof is to provide a thermoadhesive conjugate fiber enabling one to manufacture a bulky nonwoven fabric or fiber structure with high adhesive tenacity and less heat shrinkage.

In order to solve the foregoing problems, the present inventors made extensive and intensive investigations. As a result, they have achieved an invention regarding a thermoadhesive conjugate fiber having better card-passing properties than those lowly oriented high-elongation thermoadhesive conjugate fibers which have hitherto been proposed and having high adhesion and low heat shrinkability by drawing an undrawn yarn of a concentric core/sheath type or eccentric core/sheath type conjugate fiber in which a resin composition of a core component and a sheath component, a ratio of a core component to a sheath component, fluidity, an eccentric state, and the like are properly set up in a low draw ratio at a temperature higher than a glass transition temperature of each of a core and a sheath and simultaneously subjecting to a fixed-length heat treatment and subsequently subjecting to a relaxation heat treatment at a higher temperature.

More specifically, the foregoing problems can be solved by an invention regarding a thermoadhesive conjugate fiber which is a conjugate fiber made of a fiber forming resin component and a thermoadhesive resin component, wherein the thermoadhesive resin component is made of a crystalline thermoplastic resin having a melting point of at least 20° C. lower than that of the fiber forming resin component and that the conjugate fiber has a breaking elongation of from 60 to 600% and a dry heat shrinkage percentage at 120° C. of from −10.0 to 5.0%. Also, the foregoing problems can be solved by an invention regarding a manufacturing method of the foregoing thermoadhesive conjugate fiber, which includes drawing an undrawn yarn of a conjugate fiber taken up at a spinning rate of from 150 to 1,800 m/min in a low draw ratio of from 0.5 to 1.3 times at a temperature higher than both a glass transition temperature of a major crystalline thermoplastic resin of the thermoadhesive resin component and a glass transition temperature of the fiber forming resin component and simultaneously subjecting to a fixed-length heat treatment and subsequently subjecting to a heat treatment under no tension at a temperature of at least 5° C. higher than the temperature of the fixed-length heat treatment.

The invention is able to improve card-passing properties which are a drawback of low orientation type thermoadhesive conjugate fibers with high adhesion and low heat shrinkability which have hitherto been proposed and to improve productivity of nonwoven fabrics. Furthermore, in the thermoadhesive conjugate fiber of the invention, since the fiber itself has self-elongation, a nonwoven fabric after thermal adhesion is finished bulkily and is excellent in texture to an extent that it has not been seen so far; and the invention largely contributes to expansion of commercial production of bulky nonwoven fabrics. Also, the thermoadhesive conjugate fiber of the invention makes it possible to provide a thermoadhesive nonwoven fabric with satisfactory web grade.

DESCRIPTION OF THE PREFERRED EMBODIMENTS

Embodiments of the invention are hereunder described in detail. The thermoadhesive conjugate fiber of the invention is made of a fiber forming resin component and a thermoadhesive resin component. Furthermore, with respect to the thermo-adhesive resin component, a crystalline thermoplastic resin having a melting point of at least 20° C. lower than that of the fiber forming resin component must be selected. When a difference in melting point between the fiber forming resin component and the thermoadhesive resin component is less than 20° C., the fiber forming resin component is also molten in a process for melting and adhering the thermoadhesive resin component so that a nonwoven fabric or fiber structure with high strength cannot be manufactured.

Though the resin of the fiber forming resin component is not particularly limited, a crystalline thermoplastic resin having a melting point of 130° C. or higher is preferable. Specific examples thereof include polyolefins such as high density polyethylene (HDPE) or isotactic polypropylene (PP), or copolymers containing it as a major component; polyamides such as nylon-6 or nylon-66; and polyesters such as polyethylene terephthalate, polytrimethylene terephthalate, polybutylene terephthalate, or polyethylene naphthalate. A polyester capable of imparting proper stiffness to a web or a nonwoven fabric in the foregoing manufacture method, and especially polyethylene terephthalate (PET) is preferably used.

Also, with respect to the crystalline thermoplastic resin constituting the thermoadhesive resin component, a crystalline thermoplastic resin having a melting point of at least 20° C. lower than that of the fiber forming resin component must be selected. In the case where the crystalline thermo-plastic resin is constituted of plural kinds of resins, it is preferable that a melting point of a major crystalline thermoplastic resin is satisfied with the foregoing condition. The term "major" as referred to herein means a degree such that in the case where the thermoadhesive resin component is a polymer blend as described later, the characteristic features of the conjugate fiber of the invention are not lost as a whole. Concretely, its proportion is preferably 55% by weight or more, and more preferably 60% by weight or more based on the whole weight of the thermoadhesive resin component. When the thermoadhesive resin component is an amorphous thermoplastic resin, following the matter that a molecular chain which has been oriented at the time of spinning becomes non-oriented at the same time of melting, the fiber largely shrinks. Though the crystalline thermoplastic resin constituting the thermoadhesive resin component is not particularly limited, preferred examples thereof include polyolefin resins and crystalline copolyesters.

Specific examples of the polyolefin resin include homopolyolefins such as crystalline polypropylene, high density polyethylene, middle density polyethylene, low density polyethylene, and linear low density polyethylene. Furthermore, the polyolefin resin constituting the thermoadhesive resin component may be a copolyolefin resulting from copolymerization of at least one member of unsaturated compounds including ethylene, propylene, butene, pentene-1; or acrylic acid, methacrylic acid, maleic acid, fumaric acid, itaconic acid, crotonic acid, isocrotonic acid, mesaconic acid, citraconic acid or himic acid, or esters thereof or acid anhydrides thereof with the foregoing homopolyolefin.

Also, as the crystalline copolyester, the following polyesters can be preferably enumerated. That is, there can be enumerated polyesters resulting from copolymerization of an aromatic dicarboxylic acid such as isophthalic acid, naphthalene-2,6-dicarboxylic acid or 5-sulfoisophthalic acid salt; an aliphatic dicarboxylic acid such as adipic acid or sebacic acid; an alicyclic dicarboxylic acid such as cyclohexamethylenedicarboxylic acid; an ω-hydroxyalkanecarboxylic acid; an aliphatic diol such as polyethylene glycol or polytetramethylene glycol; or an alicyclic diol such as cyclohexamethylenedimethanol with an alkylene terephthalate so as to exhibit a desired melting point. As the alkylene terephthalate, there are enumerated polyesters obtained from, as a raw material, a combination of terephthalic acid or an ester forming derivative thereof as a major dicarboxylic acid and one to three kinds of ethylene glycol, diethylene glycol, trimethylene glycol, tetramethyle glycol, hexamethylene glycol or a derivative thereof as a major diol component.

An embodiment of the thermoadhesive conjugate fiber of the invention may be a conjugate fiber resulting from sticking the fiber forming resin component and the thermoadhesive resin component to each other in a so-called side-by-side type or a core/sheath type conjugate fiber in which the both components have a core/sheath structure. However, from the standpoint that the thermoadhesive resin component is disposed in all directions perpendicular to the fiber axis direction, a core/sheath type conjugate fiber in which the fiber forming resin component is a core component and the thermoadhesive resin component is a sheath component is preferable. Also, examples of the core/sheath type conjugate fiber include a concentric core/sheath type conjugate fiber and an eccentric core/sheath type conjugate fiber.

In the case where the thermoadhesive conjugate fiber of the invention is a core/sheath type conjugate fiber, what its weight ratio of the fiber forming resin component to the thermoadhesive resin component (core component/sheath component) is from 60/40 to 10/90 is preferable from the standpoint that a crimp performance can be imparted such that the card-passing properties become satisfactory. Furthermore, the subject weight ratio is more preferably from 55/45 to 20/80. Reasons for this are considered as follows. That is, in the relaxation heat treatment, the resin constituting the sheath component in the conjugate fiber is softened to cause heat shrinkage. At that time, when the weight ratio of the resin of the sheath component in the conjugate fiber increases, the resin of the core component in the conjugate fiber is easy to deform. Accordingly, it is thought that spiral crimp of the conjugate fiber is easy to reveal. When the weight ratio of the sheath component is less than 40% by weight, since a force for deforming the resin of the core component due to shrinkage is small, the spiral crimp is hard to reveal. Inversely, when the weight ratio of the resin of the sheath component exceeds 90% by weight, the spiral crimp is excessively large so that plugging of the fiber tends to be generated within card equipment. By controlling the feed amounts of the both resin components at the time of spinning, it is possible to control a range of the weight ratio of the fiber forming resin component to the thermoadhesive resin component.

A characteristic feature of the thermoadhesive conjugate fiber of the invention resides in the matter that a breaking elongation is from 60 to 600% and a dry heat shrinkage percentage at 120° C. is from −10.0 to 5.0%, and the invention is required to be provided with adhesive tenacity, low heat shrinkability and satisfactory card-passing properties. It is more preferable that the invention is satisfied with a ratio of percentage of crimp and number of crimp (percentage of crimp/number of crimp) is satisfied to be 0.8 or more.

In order to suppress the orientation of the resin of the thermoadhesive resin component on a low level, the breaking elongation of the thermoadhesive conjugate fiber must be controlled to a range of from 60 to 600%. The breaking elongation is preferably in the range of from 80 to 500%, and more preferably in the range of from 130 to 450%. When the breaking elongation is less than 60%, since the orientation of the thermoadhesive resin component is high, the adhesion is poor, and the nonwoven fabric strength is reduced. Also, when the breaking elongation exceeds 600%, since the fiber strength is substantially low, the strength of the thermoadhesive nonwoven fabric cannot be increased.

Also, the dry heat shrinkage percentage at 120° C. of the thermoadhesive conjugate fiber must be controlled to a range of from −10.0 to 5.0%. The dry heat shrinkage percentage at 120° C. is more preferably in the range of from −10.0 to 1.0%. By controlling the dry heat shrinkage percentage at 120° C. to this range, the shrinkage at the time of thermal adhesion is small, a deviation of an adhesion point at the point of intersection between fibers is small, and the adhesion point is strong. Furthermore, when the dry heat shrinkage percentage at 120° C. is a negative value and the fiber is in a slightly self-elongated state upon heating, a fiber density in the nonwoven fabric prior to the thermal adhesion is reduced, and finish is bulky, whereby a nonwoven fabric having soft and smooth texture can be formed. When the dry heat shrinkage percentage at 120° C. exceeds 5.0%, the point of adhesive intersection at the time of thermal adhesion is deviated and the adhesive strength tends to be reduced, and therefore, such does not contribute to a targeted improvement in the adhesion tenacity. On the other hand, when the dry heat shrinkage percentage at 120° C. of the conjugate fiber is less than −10.0% to reveal self-elongation, the adhesive point is deviated, too, and the strength of the non-woven fabric is moved to a direction where it is reduced.

For the purpose of manufacturing a conjugate fiber having the both characteristics of a high breaking elongation and a low dry heat shrinkage percentage at 120° C. as described previously, this purpose is achieved by performing drawing in a low drawing ratio of from approximately 0.5 to 1.3 times as a drawing draft and simultaneously performing a fixed-length heat treatment. Furthermore, under a condition where the drawing draft of less than 1.0 time, concretely when an overfeed ratio is high or a temperature of the relaxation heat treatment is high, a self-elongation ratio of the conjugate fiber tends to be large. However, in the case of manufacturing a nonwoven fabric by using a conjugate fiber to which proper self-elongation has been imparted, the subject nonwoven fabric is finished bulkily, and in the case of manufacturing a fiber structure, the subject fiber structure is finished at a low density. The dry heat shrinkage percentage at 120° C. of the conjugate fiber is preferably in the range of from −8.0 to −0.2%, and more preferably in the range of from −6.0 to −1.0%.

A cross section of the conjugate fiber is preferably a concentric core/sheath type cross section or an eccentric core/sheath type cross section. In the case where the cross section of the conjugate fiber is a side-by-side type cross section, even in undrawn yarns, spiral crimp is largely revealed and it is difficult to control the revealment of spiral crimp on a low level, the card-passing properties of the obtained conjugate fiber are rather deteriorated. Also, in the case where the cross section of the conjugate fiber is of a side-by-side type, the adhesive strength of the conjugate fiber tends to be small, and the targeted effects of the invention are somewhat reduced.

Also, the cross section of the conjugate fiber may be a solid fiber or a hollow fiber; and the external shape is not limited to a round cross section, and it may be a modified cross section such as an oval cross section, a multi-foliate cross section including three to eight foliate cross sections, and a polygonal cross section including triangular to octagonal shapes. The terms "multi-foliate cross section" as referred to herein means a cross-sectional shape having plural convexes extending from a central part to a peripheral direction. A fineness may be selected depending upon the purpose and is not particularly limited. However, in general, the fineness is preferably in the range of from approximately 0.01 to 500 dtex. This fineness range can be achieved by regulating a nozzle size from which the resin is discharged at the time of spinning at a prescribed range or the like.

In particular, for the purpose of increasing the adhesive tenacity, it is preferable that the thermoadhesive resin component of the sheath component constituting the conjugate fiber has a melt flow rate (hereinafter referred to as "MFR") in the range of from 1 to 15 g/10 min. The MFR includes an aspect for expressing fluidity of a polymer at the time of heat melting and an aspect which is a standard of a molecular weight of a polymer. In general, when the MFR increases, the fluidity of a polymer is good or the molecular weight of a polymer tends to be low. It has been considered that in thermoadhesive conjugate fibers of the related art, when the MFR is large as a fixed value or more, the fluidity of the sheath component is insufficient at the thermal adhesion temperature so that a strong thermal adhesion point is not formed. In many cases, those having an MFR of 20 g/10 min or more (under a condition at a measurement temperature of 190° C. and at a load of 21.18 N; or in the case of polypropylene, under a condition at a measurement temperature of 230° C. and at a load of 21.18 N) are used. According to the conjugate fiber of the invention, even when the MFR is less than 20 g/10 min, it is possible to make the fluidity at the adhesion temperature satisfactory and to make the molecular weight high. Accordingly, since the breaking strength of the thermoadhesive resin component itself can be increased, a strong thermal adhesion point can be formed. Though even when the MFR is 20 g/10 min or more, its effect is the same, in particular, for the purpose of bringing out the characteristic features of the invention, the MFR is preferably not more than 15 g/10 min. However, what the MFR is smaller than 1 g/10 min is not preferable because the thermoadhesive resin component is inferior in sufficient spinnability in melting spinning, and yarn breakage is easy to occur at the time of spinning. Accordingly, the MFR is preferably in the range of from 1 to 15 g/10 min, and more preferably in the range of from 2 to 12 g/10 min. Those skilled in the art are able to select resins which are in agreement with the foregoing range and are proper for the respective components by measuring an MFR of each of the resin components prior to the manufacture of a conjugate fiber.

As a method for improving the revealment of spiral crimp, the matter that the melt flow rate (MFR) of the major crystalline thermoplastic resin constituting the thermo-adhesive resin component is at least 5 g/10 min smaller than the MFR of the fiber forming resin component is an effective measure, too. By setting up so as to meet this requirement, an elongation viscosity of the thermoadhesive resin component in melt spinning becomes higher than that of the fiber forming resin component. Accordingly, the orientation of the fiber forming resin component is insufficient, and heat shrinkage is liable to occur in a state after the fixed-length heat treatment of an undrawn yarn, thereby bringing an effect for easily revealing spiral crimp.

When a difference between MFR of the major crystalline thermoplastic resin constituting the thermoadhesive resin component and MFR of the fiber forming resin component is less than 5 g/10 min, since an effect for suppressing the orientation of the fiber forming resin component is low, an effect for revealing spiral crimp is low. The difference of MFR is preferably 10 g/10 min or more. Those skilled in the art are able to select resins which are in agreement with the foregoing range and are proper for the respective components by measuring an MFR of each of the resin components prior to the manufacture of a conjugate fiber.

Incidentally, the thermoadhesive resin component in the invention may be a constitution of a polymer blend made of from 100 to 60% by weight of a crystalline thermoplastic resin A and from 0 to 40% by weight of a crystalline thermoplastic resin B or a constitution of a polymer blend of three or more kinds of crystalline thermoplastic resins. Furthermore, the thermoadhesive resin component may be a constitution of a polymer blend made of from 100 to 60% by weight of a high-melting point crystalline thermoplastic resin and from 0 to 40% by weight of a low-melting point crystalline thermoplastic resin, or a constitution of a polymer blend of three or more kinds of crystalline thermoplastic resins having a different melting point from each other, with a crystalline thermoplastic resin having the highest melting point accounting for from 100 to 60% by weight. With respect to the thermoadhesive resin component, a constitution of a polymer blend in which a difference between a melting point of the crystalline thermoplastic resin A or the crystalline thermoplastic resin having the highest melting point and a melting point of the crystalline thermoplastic resin B or the crystalline thermoplastic resin having the lowest melting point is 20° C. or more and the crystalline thermoplastic resin having the lowest melting point accounts for not more than 40% by weight in the thermoadhesive resin component is more preferable because the low-melting point crystalline thermoplastic resin is molten before the whole of the thermoadhesive resin component is molten, whereby the sheath component causes heat shrinkage and spiral crimp is revealed in the conjugate fiber. However, the content of the crystalline thermoplastic resin having the lowest melting point in the thermoadhesive resin component exceeding 40% by weight is not preferable because a dispersion structure is reversed and the revealment of spiral crimp is low. Furthermore, the content of the crystalline thermoplastic resin having the lowest melting point in the thermoadhesive resin component is preferably from 3 to 35% by weight. Also, even by adding an amorphous thermoplastic resin having a glass transition temperature of at least 20° C. lower than a melting point of the crystalline thermoplastic resin in a high-melting point side (the crystalline thermoplastic resin A or other) in place of the crystalline thermoplastic resin in a low-melting point side (the crystalline thermoplastic resin B or other), the same effects can be expected. In that case, it is desirable that the addition amount of the amorphous thermoplastic resin is limited to a range of from 0.2 to 10% by weight, and preferably a range of from 1 to 8% by weight based on the weight of the thermoadhesive resin component. When the addition amount of the amorphous thermoplastic resin exceeds 10% by weight, the shrinkage of the thermoadhesive resin component is large so that low shrinkage as a characteristic feature of the invention is not satisfied. On the other hand, when the subject addition amount is less than 0.2% by weight, sufficient spiral crimp is not revealed in the conjugate fiber.

In the case where the thermoadhesive resin component is in the foregoing polymer blend state, a resin which is suitable for use as the crystalline thermoplastic resin can be properly selected among the foregoing crystalline thermoplastic resins constituting the thermoadhesive resin component. Also, examples of the amorphous thermoplastic resin include polyethylene terephthalate having from 50 to 20% by mole of isophthalic acid as a dicarboxylic acid component co-polymerized therewith, atactic polystyrene, polyacrylonitrile, and polymethyl methacrylate. Polyethylene terephthalate having isophthalic acid copolymerized therewith is especially preferable because its glass transition temperature is from approximately 60 to 65° C.

Also, in order to obtain such a polymer blend, the polymer blend can be obtained by melt kneading plural resins constituting the thermoadhesive resin component at a temperature of the melting points or higher or the melting point and glass transition temperature of all of the resins in, for example, a single screw or twin-screw extruder. In order to control the dispersion state of the resins, it is preferred to thoroughly consider a blending amount, a kneading temperature, a residence time at the time of melting, and the like of the resins.

With respect to the manufacturing method of the conjugate fiber of the invention, the conjugate fiber is obtained by a manufacturing method by drawing an undrawn yarn taken up at a spinning rate of from 150 to 1,800 m/min in a low draw ratio of from 0.5 to 1.3 times at a temperature higher than both a glass transition temperature of a major crystalline thermoplastic resin of the thermoadhesive resin component and a glass transition temperature of the fiber forming resin component by employing a known melting method of a conjugate fiber or by using a known nozzle and simultaneously subjecting to a fixed-length heat treatment. The spinning rate is preferably from 300 to 1,500 m/min, and more preferably from 500 to 1,300 m/min. When the spinning rate exceeds, 1,800 m/min, the orientation of an undrawn yarn increases; high adhesion targeted in the invention is inhibited; yarn breakage frequently occurs; and the productivity is deteriorated. Also, in the case where the spinning rate is slower than 150 m/min, as a matter of course, the productivity of fiber is deteriorated.

The "fixed-length heat treatment" as referred to herein is a heat treatment in which an undrawn yarn obtained by melt spinning is heat treated in a state of applying a drawing draft of from 0.5 to 1.3 times. The heat treatment is carried out in a draw ratio of 1.0 time such that deformation is not substantially generated in a fiber axis direction before and after the heat treatment. However, in the case where thermal elongation is generated in the undrawn yarn in view of properties of the resin, in order to prevent loose of filaments between rollers of a drawing machine, a drawing draft of more than 1.0 time may be applied. Furthermore, what a low drawing draft of from 1.05 to 1.3 times is imparted may be preferable depending upon a combination of resins because a properly high crimp performance can be imparted while keeping high adhesive performance and low shrinkage. When the drawing draft exceeds 1.3 times, the fiber is largely drawn, and as a result, the dry heat shrinkage percentage at 120° C. of the conjugate fiber exceeds 5%, whereby low shrinkability and high adhesion targeted in the invention are not satisfied. Also, in view of properties of a resin, in the case where strong heat shrinkage is generated originated from spinning and drawing conditions, the orientation of the fiber may possibly increase. Thus, instead of applying a drawing draft of more than 1.0 time, a draft (overfeed) of less than 1.0 time may be applied to such a degree that the undrawn yarn does not generate loose during drawing. It is preferred to apply a draft (overfeed) of from 0.5 to 0.9 times. However, a lower limit of the draft is approximately 0.5 times. When the draft is less than this, not only almost all of polymers are insufficiently shrunken so that a tow is easy to sag, but also it is often difficult to suppress the elongation of the conjugate fiber to not more than 600%.

Also, in the case where the thermoadhesive resin component is the foregoing constitution of a polymer blend, the fixed-length heat treatment is carried out at a temperature of higher than both a glass transition temperature of the major crystalline thermoplastic resin of the thermoadhesive resin component and a glass transition temperature of the fiber forming resin composition. What the temperature of the fixed-length heat treatment is lower than this range is not preferable because the shrinkage percentage at the time of thermal adhesion of the conjugate fiber is large. The fixed-length heat treatment may be carried out on a heater plate, under blowing hot air, in high-temperature air, under blowing water vapor, or in a liquid heating medium such as warm water or silicon oil bath. Above all, it is preferred to carry out the fixed-length heat treatment in warm water which is good in thermal efficiency and which does not require rinsing during subsequent impartment of a fiber treating agent.

Subsequent to such a fixed-length heat treatment, it is also preferred to impart a lubricant after passing through or bypassing a crimper with a stuffing box. Thereafter, a heat treatment (relaxation heat treatment) is carried out at a temperature of at least 5° C., and more preferably at least 10° C. higher than the temperature of the fixed-length heat treatment and under no tension. By this operation, the undrawn yarn or the yarn drawn in a low draw ratio reveals spiral crimp, and a crimp performance for ensuring card-passing properties is revealed. In the case of not passing through a crimper with a stuffing box, spiral three-dimensional spiral crimp is revealed; and in the case of passing through a crimper with a stuffing box and applying buckling to the single yarn, an omega type planar crimp is revealed. Any of these methods may be employed so far as the method falls within the range of crimp performance of the invention. A heating method in the relaxation heat treatment is carried out in hot air, namely by blowing hot air into the fiber. This is preferable in view of the matters that the thermal efficiency is good and that the fiber is less restrained so that crimp of the fiber is easy to reveal. A temperature of the relaxation heat treatment may be determined depending upon requirements in a targeted crimp performance of the fiber which is intended to be obtained and a latent crimp performance which is intended to be revealed at the time of thermal adhesion of a nonwoven fabric or a fiber structure. In the case where the heat treatment to be carried out subsequent to this fixed-length heat treatment is carried out not under no tension and in the case where the temperature of the heat treatment is not a temperature of at least 5° C. higher than the temperature of the fixed-length heat treatment, it is impossible to impart sufficient crimp to the conjugate fiber. Accordingly, it is impossible to regulate the percentage of crimp/number of crimp of the conjugate fiber at a prescribed value or more.

Originally, though it is difficult to impart mechanical crimp to an undrawn yarn, a yarn drawn in a low draw ratio or a yarn obtained by high-speed spinning, it is possible to enhance both the number of crimp and the percentage of crimp by the foregoing method. In setting up the crimp performance, it is better that the percentage of crimp is set up large such that a ratio of the percentage of crimp (CD) to the number of crimp (CN), namely CD/CN as defined in Japanese Industrial Standards L1015: 8.12.1 to 8.12.2 (2005) is 0.8 or more, and preferably 1.0 or more. A range of CN is from 6 to 25 peaks/25 mm, and more preferably from 8 to 20 peaks/25 mm. A range of CD is from 6 to 40%, and preferably from 8 to 35%. What the CD falls within this range is preferable because both high-speed card-passing properties and texture of a web can be made compatible with each other. With respect to CN and CD, when they exceed the upper limits, the texture of a web is deteriorated, whereas when they are less than the lower limits, the web obtained by card-passing is easy to break so that the high-speed card-passing properties are deteriorated. Incidentally, for the purpose of adjusting a balance between the number of crimp and the percentage of crimp to make the CD/CN ratio fall within the foregoing range, a method in which a temperature of the tow before the crimper is increased by a measure such as heating with steam, heating by a heater, and heating with warm water is carried out. Even by other measures than those enumerated herein, in general, when the tow temperature is increased, the percentage of crimp can be largely adjusted.

Furthermore, when the composition of the thermoadhesive resin composition is 1) a core/sheath type conjugate fiber in which MFR of the major crystalline thermoplastic resin constituting the thermoadhesive resin component is at least 5 g/10 min lower than MFR of the fiber forming resin component; 2) a core/sheath type conjugate fiber in which the thermoadhesive resin component is a polymer blend made of from 100 to 60% by weight of the crystalline thermoplastic resin A and from 0 to 40% by weight of the crystalline thermoplastic resin B; or 3) a core/sheath type conjugate fiber in which the thermoadhesive resin component is a polymer blend made of from 99.8 to 90% by weight of the crystalline thermoplastic resin A and from 0.2 to 10% by weight of the amorphous thermoplastic resin, it is possible to manufacture the conjugate fiber of the invention in the same manufacturing method as described previously.

With respect to the form of the thermoadhesive conjugate fiber of the invention, any form of multi-filament, monofilament, staple fiber, chop, tow, etc. can be taken depending upon the use purpose. In the case of using the thermoadhesive conjugate fiber of the invention as a staple fiber which requires a card process, in order to impart satisfactory card-passing properties to the subject thermoadhesive conjugate fiber, it is desired to impart the number of crimp having a proper numerical value range.

EXAMPLES

The invention is more specifically described below with reference to the following Examples, but it should be construed that the invention is not limited thereto whatsoever. Incidentally, the respective items in the Examples were measured by the following methods.

(1) Intrinsic Viscosity (IV):

An intrinsic viscosity of a polyester was measured at 35° C. in a usual way after weighing a fixed amount of the polymer and dissolving it in o-chlorophenol in a concentration of 0.012 g/mL.

(2) Melt Flow Rate (MFR)

MFR of a polypropylene resin was measured according to Japanese Industrial Standards K7210, Condition 14 (measurement temperature: 230° C., load: 21.18 N); MFR of a polyethylene terephthalate resin was measured according to Japanese Industrial Standards K7210, Condition 20 (measurement temperature: 280° C., load: 21.18 N); and MFR of other resins was measured according to Japanese Industrial Standards K7210, Condition 4 (measurement temperature:

190° C., load: 21.18 N). Incidentally, MFR is a value measured by using, as a sample, a pellet prior to melt spinning.

(3) Melting Point (Tm) and Glass Transition Temperature (Tg)

A melting point and a glass transition temperature of a polymer were measured at a temperature rise rate of 20° C./min by using Thermal Analyst 2200, manufactured by TA Instruments, Japan.

(4) Fineness:

A fineness of a conjugate fiber was measured by a method described in Japanese Industrial Standards L1015: 8.5.1 A Method (2005).

(5) Strength and Elongation:

Tenacity and elongation of a conjugate fiber were measured by a method described in Japanese Industrial Standards L1015: 8.7.1 Method (2005).

In the conjugate fiber of the invention, since a scattering in the strength and elongation is liable to be generated due to the efficiency of the fixed-length heat treatment, in the case where the strength and elongation are measured in a single yarn, the number of measurement point must be increased. Since the number of measurement point is preferably 50 or more, the number of measurement point is set up at 50 herein, and an average value thereof is defined as the strength and elongation.

(6) Number of Crimp and Percentage of Crimp:

Number of crimp and percentage of crimp were measured by a method described in Japanese Industrial Standards L1015: 8.12.1 to 8.12.2 Methods (2005).

(7) Dry Heat Shrinkage Percentage at 120° C.:

A dry heat shrinkage percentage at 120° C. of a conjugate fiber was measured at a temperature of 120° C. in a method described in Japanese Industrial Standards L1015: 8.15 b) Method (2005).

(8) High-Speed Card-Passing Properties:

High-speed card-passing properties were evaluated by using a JM type small-sized high-speed card machine, manufactured by Torigoe Spinning Machine Mfg., Co., Ltd. In spinning a card web with a basis weight of 25 g/m$^2$ and made of 100% of a thermoadhesive conjugate fiber, a rate of 5 m/min smaller than a doffer rate at which the card web started to cut was defined as a maximum card rate. It is evaluated that the larger this value, the more satisfactory the high-speed card-passing properties.

(9) Web Texture:

A grade of a web obtained by the foregoing high-speed card-passing test or an airlaid nonwoven fabric manufacturing method was evaluated by five panelists according to the following criteria.

(Level 1)

The fiber density is uniform, a defect of the external appearance such as pilling is not conspicuous, and good external appearance is exhibited.

(Level 2)

The fiber density is slightly non-uniform, and a little bit of a portion with low density is observed.

(Level 3)

A lot of roughness and fineness is observed, and the external appearance is poor.

(10) Percentage of Area Shrinkage of Web:

A web made of 100% of a thermoadhesive conjugate fiber obtained in the foregoing high-speed card-passing test or an airlaid with a basis weight of 25 g/m$^2$ and made of 100% of a thermoadhesive conjugate fiber obtained by an airlaid nonwoven fabric manufacturing method was cut into a size of 30 cm in square and allowed to stand in a hot air dryer (hot air circulation constant temperature dryer: 41-S4, manufactured by Satake Chemical Equipment Mfg., Ltd.) kept at a prescribed temperature for 2 minutes to achieve a heat treatment, thereby thermally adhering the conjugate fibers to each other. A percentage of area shrinkage is determined from a web area A0 prior to the heat shrinkage treatment and a web area A1 after the heat shrinkage treatment at the time of thermal adhesion according to the following expression.

$$\text{Percentage of area shrinkage (\%)}=[(A0-A1)/A0]\times 100$$

(11) Strength of Nonwoven Fabric (Adhesive Strength):

After the heat treatment, a specimen of 5 cm in width and 20 cm in length was cut out from the web, and a tensile breaking force of the nonwoven fabric was measured under a measurement condition at a gripping gap of 10 cm and at an elongation rate of 20 cm/min. An adhesive strength was defined as a value obtained by dividing the tensile breaking force (N) by a weight (g) of the specimen.

EXAMPLE 1

Polyethylene terephthalate (PET) of IV 0.64 dL/g, MFR=25 g/10 min, Tg=70° C. and Tm=256° C. was used for a core component (fiber forming resin component); and high density polyethylene (HDPE) of MFR=20 g/10 min and Tm=131° C. (Tg: lower than 0° C.) was used for a sheath component (thermoadhesive resin component). These resins were molten at 290° C. and 250° C., respectively; and an eccentric core/sheath type conjugate fiber was formed in a weight ratio of the core component to the sheath component of 50/50 (% by weight) by using a known nozzle for eccentric core/sheath type conjugate fiber and spun under a condition at a discharge amount of 0.71 g/min/hole and at a spinning rate of 1,150 m/min, thereby obtaining an undrawn yarn. The subject undrawn yarn was drawn in a low draw ratio of 1.0 time in warm water of 90° C. which temperature was 20° C. higher than the glass transition temperature of the resin of the core component and simultaneously subjected to a fixed-length heat treatment. Subsequently, the filaments obtained by the fixed-length heat treatment were dipped in an aqueous solution of a lubricant made of a lauryl phosphate potassium salt, and eleven mechanical crimps per 25 mm were imparted thereto by using a crimper with a stuffing box. Furthermore, the subject filaments were dried at 110° C. under no tension (relaxation heat treatment) and then cut in a fiber length of 51 mm. As a result, there was obtained a conjugate fiber having an omega type crimp form. The fiber manufacturing condition, physical properties of fiber, maximum card rate and physical properties of nonwoven fabric were shown in Tables 1 and 3.

EXAMPLE 2 AND EXAMPLE 3

Conjugate fibers were manufactured under the same condition as in Example 1, except for changing the weight ratio of the core component to the sheath component. There were thus obtained conjugate fibers having a single yarn fineness of 6.7 dtex and 6.5 dtex, respectively. The results were shown in Tables 1 and 3.

EXAMPLE 4

A conjugate fiber was manufactured under the same condition as in Example 1, except for changing the discharge amount to 0.53 g/min/hole and changing the draw ratio at the time of fixed-length heat treatment to 0.7 times. There was thus obtained a conjugate fiber having a single yarn fineness of 6.6 dtex. The results were shown in Tables 1 and 3.

EXAMPLE 5 AND COMPARATIVE EXAMPLE 1

Conjugate fibers were obtained under a condition as shown in Table 1, except for changing the nozzle to a nozzle for concentric core/sheath type conjugate fiber. The results were shown in Tables 1 and 3.

EXAMPLE 6

Polyethylene terephthalate (PET) of IV 0.64 dL/g, MFR=25 g/10 min, Tg=70° C. and Tm=256° C. was used for a core component (fiber forming resin component); and isotactic polypropylene (PP) of MFR=8 g/10 min and Tm=165° C. (Tg: lower than 0° C.) was used for a sheath component (thermoadhesive resin component). These resins were molten at 290° C. and 260° C., respectively; and a concentric core/sheath type conjugate fiber was formed in a weight ratio of the core component to the sheath component of 50/50 (% by weight) by using a known nozzle for concentric core/sheath type conjugate fiber and spun under a condition at a discharge amount of 1.0 g/min/hole and at a spinning rate of 900 m/min, thereby obtaining an undrawn yarn. The subject undrawn yarn was drawn in a low draw ratio of 1.25 times in warm water of 90° C. which temperature was 20° C. higher than the glass transition temperature of the resin of the core component and simultaneously subjected to a fixed-length heat treatment. Subsequently, the filaments obtained by the fixed-length heat treatment were dipped in an aqueous solution of a lubricant made of a lauryl phosphate potassium salt, and eleven mechanical crimps per 25 mm were imparted thereto by using a crimper with a stuffing box. Furthermore, the subject filaments were dried at 130° C. under no tension and under hot air at 130° C. (relaxation heat treatment) and then cut in a fiber length of 51 mm. As a result, there was obtained a conjugate fiber having an omega type crimp form and having a single yarn fineness of 8.8 dtex. The fiber manufacturing condition, physical properties of fiber, maximum card rate and physical properties of nonwoven fabric were shown in Tables 2 and 4.

EXAMPLE 7

A conjugate fiber was manufactured under the same condition as in Example 6, except for changing the discharge amount to 0.8 g/min/hole and changing the draw ratio of drawing to be carried out at the same time of the fixed-length heat treatment to 1.0 time. There was thus obtained a conjugate fiber having a single yarn fineness of 8.7 dtex. The results were shown in Tables 2 and 4.

EXAMPLE 8

Polyethylene terephthalate (PET) of IV 0.64 dL/g, MFR=25 g/10 min, Tg=70° C. and Tm=256° C. was used for a core component (fiber forming resin component); and a pellet of a blend of 80% by weight of isotactic polypropylene (PP) of MFR=8 g/10 min and Tm=165° C. (Tg: lower than 0° C.) and 20% by weight of maleic anhydride-methyl acrylate graft copolyethylene (copolymerization rate of maleic anhydride=2% by weight, copolymerization rate of methyl acrylate=7% by weight; hereinafter abbreviated as "m-PE") of MFR=8 g/10 min and Tm=98° C. (Tg: lower than 0° C.) was used for a sheath component (thermoadhesive resin component). These resins were molten at 290° C. and 250° C., respectively; and a concentric core/sheath type conjugate fiber was formed in a weight ratio of the core component to the sheath component of 50/50 (% by weight) by using a known nozzle for concentric core/sheath type conjugate fiber and spun under a condition at a discharge amount of 0.94 g/min/hole and at a spinning rate of 900 m/min, thereby obtaining an undrawn yarn. The subject undrawn yarn was drawn in a low draw ratio of 1.2 times in warm water of 90° C. which temperature was 20° C. higher than the glass transition temperature of the resin of the core component and simultaneously subjected to a fixed-length heat treatment. Subsequently, the filaments obtained by the fixed-length heat treatment were dipped in an aqueous solution of a lubricant made of a lauryl phosphate potassium salt, and eleven mechanical crimps per 25 mm were imparted thereto by using a crimper with a stuffing box. Furthermore, the subject filaments were dried under no tension and under hot air of 110° C. (relaxation heat treatment) and then cut in a fiber length of 51 mm. As a result, there was obtained a conjugate fiber having an omega type crimp form and having a single yarn fineness of 8.7 dtex. The results were shown in Tables 2 and 4.

EXAMPLE 9

A conjugate fiber was manufactured under the same condition as in Example 8, except for changing the blending amount of m-PE in the sheath component to 35% by weight. There was thus obtained a conjugate fiber having a single yarn fineness of 8.8 dtex. The results were shown in Tables 2 and 4.

EXAMPLE 10

A mixture obtained by adding 8% by weight of polyethylene terephthalate of an amorphous copolyester (polyethylene terephthalate having 40% by mole of isophthalic acid and 4% by mole of diethylene glycol copolymerized therewith; hereinafter abbreviated as "co-PET-1") against isotactic polypropylene (PP) of MFR=8 g/10 min and Tm=165° C. (Tg: lower than 0° C.) of MFR=45 g/10 nm, IV=0.56 dL/g and Tg=63° C. to the sheath component was used as the thermoadhesive resin component. Furthermore, a conjugate fiber was manufactured under the same condition as in Example 8, except for changing the discharge amount to 0.8 g/min/hole and changing the draw ratio of drawing to be carried out at the same time of the fixed-length heat treatment to 1.0 time. There was thus obtained a conjugate fiber having an omega type crimp form and having a single yarn fineness of 8.9 dtex. The results were shown in Tables 2 and 4.

EXAMPLE 11

Polyethylene terephthalate of IV=0.64 dL/g, MFR=25 g/10 min, Tg=70° C. and Tm=256° C. was used for a core component (fiber forming resin component); and a crystalline copolyester (polyethylene terephthalate having 20% by mole of isophthalic acid and 50% by mole of tetramethylene glycol copolymerized therewith; hereinafter abbreviated as "co-PET-2") of MFR=40 g/10 min, Tm=152° C. and Tg=43° C. was used as the sheath component (thermoadhesive resin component). These resins were molten at 290° C. and 255° C., respectively; and an eccentric core/sheath type conjugate fiber was formed in a weight ratio of the core component to the sheath component of 50/50 (% by weight) by using a known nozzle for eccentric core/sheath type conjugate fiber and spun under a condition at a discharge amount of 0.63 g/min/hole and at a spinning rate of 1,250 m/min, thereby obtaining an undrawn yarn. The subject undrawn yarn was drawn in a low draw ratio of 0.65 times (overfeed was carried out) in warm water of 80° C. which temperature was 10° C. higher than the glass transition temperature of the resin of the core component and simultaneously subjected to a fixed-length heat treatment. Subsequently, the filaments obtained by the fixed-length heat treatment were dipped in an aqueous solution of a lubricant made of a lauryl phosphate potassium salt, and eleven mechanical crimps per 25 mm were imparted thereto by using a crimper with a stuffing box. Furthermore, the subjected filaments were dried under hot air of 90° C. under no tension (relaxation heat treatment) and then cut in a fiber length of 51 mm. As a result, there was obtained a conjugate fiber having an omega type crimp form and having a single yarn fineness of 7.8 dtex. The results were shown in Tables 2 and 4.

COMPARATIVE EXAMPLE 2

A conjugate fiber was manufactured in the same manner as in Example 11, except for using a nozzle for concentric core/sheath type conjugate fiber and carrying out the drawing in a draw ratio of 4.35 times in warm water of 70° C. at a discharge amount of 2.05 g/min/hole and at a spinning rate of 700 m/min. There was thus obtained a conjugate fiber of mechanical crimp (zigzag type) having a single yarn fineness of 7.8 dtex. The results were shown in Tables 2 and 4.

TABLE 1

| | Thermoadhesive resin component | | | | Difference of MFR between | | Ratio of |
|---|---|---|---|---|---|---|---|
| | Kind of resin | Tm (° C.) | Tg (° C.) | MFR of major resin (g/10 min) | core and sheath (g/10 min) | Conjugate form | sheath (% by weight) |
| Example 1 | HDPE | 131 | <0 | 20 | 5 | Eccentric core/sheath | 50 |
| Example 2 | HDPE | 131 | <0 | 20 | 5 | Eccentric core/sheath | 45 |
| Example 3 | HDPE | 131 | <0 | 20 | 5 | Eccentric core/sheath | 80 |
| Example 4 | HDPE | 131 | <0 | 20 | 5 | Eccentric core/sheath | 50 |
| Example 5 | HDPE | 131 | <0 | 20 | 5 | Concentric core/sheath | 50 |
| Comparative Example 1 | HDPE | 131 | <0 | 20 | 5 | Concentric core/sheath | 50 |

| | Discharge amount per hole (g/min) | Spinning rate (m/min) | Fixed-length heat treatment | | Relaxation heat treatment |
|---|---|---|---|---|---|
| | | | Draw ratio (times) | Temperature (° C.) | Temperature (° C.) |
| Example 1 | 0.71 | 1,150 | 1.0 | 90 | 110 |
| Example 2 | 0.71 | 1,150 | 1.0 | 90 | 110 |
| Example 3 | 0.71 | 1,150 | 1.0 | 90 | 110 |
| Example 4 | 0.53 | 1,150 | 0.7 | 90 | 110 |
| Example 5 | 0.92 | 1,150 | 1.3 | 90 | 110 |
| Comparative Example 1 | 1.95 | 1,150 | 3.0 | 70 | 110 |

Note:
PET having IV of 0.64 dL/g, Tg of 70° C., Tm of 256° C. and MFR of 25 g/10 min was used as the fiber forming resin component.

TABLE 2

| | Thermoadhesive resin component | | | | Difference of MFR between | | Ratio of |
|---|---|---|---|---|---|---|---|
| | Kind of resin | Tm (° C.) | Tg (° C.) | MFR of major resin (g/10 min) | core and sheath (g/10 min) | Conjugate form | sheath (% by weight) |
| Example 6 | PP | 165 | <0 | 8 | 17 | Concentric core/sheath | 50 |
| Example 7 | PP | 165 | <0 | 8 | 17 | Concentric core/sheath | 50 |
| Example 8 | BP1 | 165 | <0 | 8 | 17 | Concentric core/sheath | 50 |
| Example 9 | BP2 | 165 | <0 | 8 | 17 | Concentric core/sheath | 50 |
| Example 10 | BP3 | 165 | <0 | 8 | 17 | Concentric core/sheath | 50 |
| Example 11 | BP4 | 152 | 43 | 40 | −15 | Eccentric core/sheath | 50 |

TABLE 2-continued

| | | | | | | | |
|---|---|---|---|---|---|---|---|
| Comparative Example 2 | BP4 | 152 | 43 | 40 | −15 | Concentric core/sheath | 50 |

| | Discharge amount per hole (g/min) | Spinning rate (m/min) | Fixed-length heat treatment Draw ratio (times) | Fixed-length heat treatment Temperature (° C.) | Relaxation heat treatment Temperature (° C.) |
|---|---|---|---|---|---|
| Example 6 | 1.0 | 900 | 1.25 | 90 | 130 |
| Example 7 | 0.8 | 900 | 1.0 | 90 | 130 |
| Example 8 | 0.94 | 900 | 1.2 | 90 | 110 |
| Example 9 | 0.94 | 900 | 1.2 | 90 | 110 |
| Example 10 | 0.8 | 900 | 1.0 | 90 | 110 |
| Example 11 | 0.63 | 1,250 | 0.65 | 80 | 90 |
| Comparative Example 2 | 2.05 | 700 | 4.35 | 70 | 90 |

Note of Table 2

1. PET having IV of 0.64 dL/g, Tg of 70° C., Tm of 256° C. and MFR of 25 g/10 min was used as the fiber forming resin component.

2. Kind of resin of thermoadhesive resin component: BP1 is a polymer blend of PP and m-PE in a blending weight ratio of 80/20. BP2 is a polymer blend of PP and m-PE in a blending weight ratio of 65/35. BP3 is a polymer blend of PP and co-PET-1 in a blending weight ratio of 92/8. BP4 is co-PET-2.

TABLE 3

| | Physical properties of fiber | | | | | | |
|---|---|---|---|---|---|---|---|
| | Fineness (dtex) | Breaking strength (cN/dtex) | Breaking elongation (%) | Dry heat shrinkage percentage at 120° C. (%) | Number of crimp: CN (peaks/25 mm) | Percentage of crimp: CD (%) | CD/CN |
| Example 1 | 6.6 | 0.8 | 455 | −1.9 | 11.9 | 11.4 | 0.96 |
| Example 2 | 6.7 | 1.35 | 470 | −2.4 | 11.1 | 12.1 | 1.09 |
| Example 3 | 6.5 | 0.6 | 412 | −0.5 | 13.2 | 11.2 | 0.85 |
| Example 4 | 6.6 | 0.75 | 485 | −2.8 | 11.2 | 11.1 | 0.99 |
| Example 5 | 6.4 | 1.12 | 399 | −0.2 | 12.1 | 10.1 | 0.83 |
| Comparative Example 1 | 6.6 | 2.5 | 37.1 | 2.5 | 12.5 | 11.9 | 0.95 |

| | | | Quality of thermoadhesive web | | |
|---|---|---|---|---|---|
| | Maximum card rate (m/min) | Web texture | Adhesion temperature (° C.) | Percentage of area shrinkage (%) | Tenacity of nonwoven fabric (N/cm/g) |
| Example 1 | 130 | Level 1 | 150 | 0 | 17.1 |
| Example 2 | 130 | Level 1 | 150 | 0 | 15.9 |
| Example 3 | 130 | Level 1 | 150 | 0 | 20.8 |
| Example 4 | 130 | Level 1 | 150 | 0 | 15.7 |
| Example 5 | 130 | Level 1 | 150 | 0 | 16.1 |
| Comparative Example 1 | 130 | Level 1 | 150 | 4.0 | 10.0 |

| | Physical properties of fiber | | | | | | |
|---|---|---|---|---|---|---|---|
| | Fineness (dtex) | Breaking strength (cN/dtex) | Breaking elongation (%) | Dry heat shrinkage percentage at 120° C. (%) | Number of crimp: CN (peaks/25 mm) | Percentage of crimp: CD (%) | CD/CN |
| Example 6 | 8.8 | 1.26 | 125 | −2.4 | 12.4 | 22.3 | 1.80 |
| Example 7 | 8.7 | 1.22 | 131 | −2.2 | 12.1 | 19.2 | 1.59 |
| Example 8 | 8.7 | 1.4 | 170 | −1.9 | 10.8 | 23.4 | 2.17 |
| Example 9 | 8.8 | 1.13 | 153 | −0.7 | 12.4 | 28.1 | 2.27 |
| Example 10 | 8.9 | 1.42 | 142 | −1.8 | 14.1 | 33.1 | 2.35 |
| Example 11 | 7.8 | 1.34 | 450 | −2.6 | 10.8 | 24.1 | 2.23 |

-continued

| | | | | | | | |
|---|---|---|---|---|---|---|---|
| Comparative Example 2 | 7.8 | 3.2 | 51 | 5.4 | 11.1 | 19.2 | 1.73 |

| | | | | Quality of thermoadhesive web | | |
|---|---|---|---|---|---|---|
| | Maximum card rate (m/min) | Web texture | Adhesion temperature (° C.) | Percentage of area shrinkage (%) | Tenacity of nonwoven fabric (N/cm/g) |
| Example 6 | 130 | Level 1 | 180 | 0 | 27.4 |
| Example 7 | 130 | Level 1 | 180 | 0 | 29.7 |
| Example 8 | 130 | Level 1 | 180 | 0 | 24.7 |
| Example 9 | 130 | Level 1 | 180 | 0 | 25.7 |
| Example 10 | 130 | Level 1 | 180 | 0 | 23.7 |
| Example 11 | 130 | Level 1 | 180 | 0 | 45.1 |
| Comparative Example 2 | 130 | Level 1 | 180 | 5.0 | 33.3 |

EXAMPLE 12

Polyethylene terephthalate (PET) of IV=0.64 dL/g, MFR=25 g/10 min, Tg=70° C. and Tm 256° C. was used for a core component (fiber forming resin component); and isotactic polypropylene (PP) of MFR=8 g/10 min and Tm=165° C. (Tg: lower than 0° C.) was used for a sheath component (thermoadhesive resin component). These resins were molten at 290° C. and 260° C., respectively; and a concentric core/sheath type conjugate fiber was formed in a weight ratio of the core component to the sheath component of 50/50 (% by weight) by using a known nozzle for concentric core/sheath type conjugate fiber and spun under a condition at a discharge amount of 1.0 g/min/hole and at a spinning rate of 900 m/min, thereby obtaining an undrawn yarn. The subject undrawn yarn was drawn in a low draw ratio of 1.0 time in warm water of 90° C. which temperature was 20° C. higher than the glass transition temperature of the resin of the core component and simultaneously subjected to a fixed-length heat treatment. Subsequently, the filaments obtained by the fixed-length heat treatment were dipped in an aqueous solution of a lubricant made of a lauryl phosphate potassium salt and polyoxyethylene-modified silicone (weight ratio=80/20), and eleven mechanical crimps per 25 mm were imparted thereto by using a crimper with a stuffing box. Furthermore, the subject filaments were dried at 95° C. (relaxation heat treatment) and then cut in a fiber length of 5.0 mm. As a result of the measurement in a tow state prior to cutting, the single yarn fineness was 11.0 dtex; the strength was 1.3 cN/dtex; the elongation was 170%; the number of crimp was 11.0 per 25 mm; the percentage of crimp was 9.5%; the percentage of crimp/number of crimp was 0.86; and the dry heat shrinkage percentage at 120° C. was −1.9%. An airlaid web was manufactured from the obtained conjugate fiber and thermally adhered at 180° C. As a result, the percentage of area shrinkage of web was 0%; the tenacity of nonwoven fabric was 9.5 kg/g; and the web texture was Level 1.

COMPARATIVE EXAMPLE 3

A concentric core/sheath type conjugate fiber was manufactured in the same manner as in Example 12, except that the fixed-length heat treatment of the undrawn yarn in warm water was not carried out. As a result of the measurement in a tow state prior to cutting, the single yarn fineness was 11.1 dtex; the strength was 1.2 cN/dtex; the elongation was 261%; the number of crimp was 11.0 per 25 mm; the percentage of crimp was 8.4%; the percentage of crimp/number of crimp was 0.76; and the dry heat shrinkage percentage at 120° C. was 25.3%. An airlaid web was manufactured from the obtained conjugate fiber and thermally adhered at 180° C. As a result, the percentage of area shrinkage of web was 25%; the tenacity of nonwoven fabric was 8.3 kg/g; and the web texture was Level 3.

COMPARATIVE EXAMPLE 4

A concentric core/sheath type conjugate fiber was manufactured in the same manner as in Example 12, except for changing the discharge amount to 2.2 g/min/hole and drawing the undrawn yarn in warm water in a draw ratio of 2.2 times. As a result of the measurement in a tow state prior to cutting, the single yarn fineness was 11.0 dtex; the strength was 2.5 cN/dtex; the elongation was 73%; the number of crimp was 11.1 per 25 mm; the percentage of crimp was 10.5%; the percentage of crimp/number of crimp was 0.94; and the dry heat shrinkage percentage at 120° C. was 8.2%. An airlaid web was manufactured from the obtained conjugate fiber and thermally adhered at 180° C. As a result, the percentage of area shrinkage of web was 6.5%; the tenacity of nonwoven fabric was 1.3 kg/g; and the web texture was Level 2.

COMPARATIVE EXAMPLE 5

A concentric core/sheath type conjugate fiber was manufactured in the same manner as in Example 12, except for changing the discharge amount to 1.5 g/min/hole and drawing the undrawn yarn in warm water in a draw ratio of 1.5 times. As a result of the measurement in a tow state prior to cutting, the single yarn fineness was 10.8 dtex; the strength was 1.8 cN/dtex; the elongation was 122%; the number of crimp was 10.8 per 25 mm; the percentage of crimp was 10.3%; the percentage of crimp/number of crimp was 0.95; and the dry heat shrinkage percentage at 120° C. was 18.9%. An airlaid web was manufactured from the obtained conjugate fiber and thermally adhered at 180° C. As a result, the percentage of area shrinkage of web was 14%; the tenacity of nonwoven fabric was 5.1 kg/g; and the web texture was Level 2.

EXAMPLE 13

Polyethylene terephthalate (PET) of IV=0.64 dL/g, MFR=25 g/10 min, Tg=70° C. and Tm=256° C. was used for a core component (fiber forming resin component); and high density polyethylene (HDPE) of MFR=20 g/10 min and Tm=133° C. (Tg: lower than 0° C.) was used for a sheath component (thermoadhesive resin component). These resins were molten at 290° C. and 250° C., respectively; and a concentric core/sheath type conjugate fiber was formed in a weight ratio of the core component to the sheath component of 50/50 (% by weight) by using a known nozzle for concentric core/sheath type conjugate fiber and spun under a condition at a discharge amount of 0.73 g/min/hole and at a spinning rate of 1,150 m/min, thereby obtaining an undrawn yarn. The subject undrawn yarn was drawn in a low draw ratio of 1.0 time in warm water of 90° C. which temperature was 20° C. higher than the glass transition temperature of the resin of the core component and simultaneously subjected to a fixed-length heat treatment. Subsequently, the filaments obtained by the fixed-length heat treatment were dipped in an aqueous solution of a lubricant made of a lauryl phosphate potassium salt and polyoxyethylene-modified silicone (weight ratio=80/20), and eleven mechanical crimps per 25 mm were imparted thereto by using a crimper with a stuffing box. Furthermore, the subject filaments were dried at 110° C. (relaxation heat treatment) and then cut in a fiber length of 5.0 mm. As a result of the measurement in a tow state prior to cutting, the single yarn fineness was 6.5 dtex; the strength was 0.8 cN/dtex; the elongation was 445%; the number of crimp was 11.2 per 25 mm; the percentage of crimp was 6.9%; the percentage of crimp/number of crimp was 0.62; and the dry heat shrinkage percentage at 120° C. was −1.6%. An airlaid web was manufactured from the obtained conjugate fiber and thermally adhered at 150° C. As a result, the percentage of area shrinkage of web was 0%; the tenacity of nonwoven fabric was 7.9 kg/g; and the web texture was Level 1.

EXAMPLE 14

Polyethylene terephthalate (PET) of IV=0.64 dL/g, MFR=25 g/10 min, Tg=70° C. and Tm=256° C. was used for a core component (fiber forming resin component); and a pellet of a blend of 80% by weight of isotactic polypropylene (PP) of MFR=8 g/10 min and Tm=165° C. (Tg: lower than 0° C.) and 20% by weight of maleic anhydride-methyl acrylate graft copolyethylene (copolymerization rate of maleic anhydride=2% by weight, copolymerization rate of methyl acrylate=7% by weight; namely m-PE) of MFR=8 g/10 min and Tm=98° C. (Tg: lower than 0° C.) was used for a sheath component (thermoadhesive resin component). These resins were molten at 290° C. and 250° C., respectively; and a concentric core/sheath type conjugate fiber was formed in a weight ratio of the core component to the sheath component of 50/50 (% by weight) by using a known nozzle for concentric core/sheath type conjugate fiber and spun under a condition at a discharge amount of 0.73 g/min/hole and at a spinning rate of 1,150 m/min, thereby obtaining an undrawn yarn. The subject undrawn yarn was drawn in a low draw ratio of 1.0 time in warm water of 90° C. which temperature was 20° C. higher than the glass transition temperature of the resin of the core component and simultaneously subjected to a fixed-length heat treatment. Subsequently, the filaments obtained by the fixed-length heat treatment were dipped in an aqueous solution of a lubricant made of a lauryl phosphate potassium salt and polyoxyethylene-modified silicone (weight ratio=80/20), and eleven mechanical crimps per 25 mm were imparted thereto by using a crimper with a stuffing box. Furthermore, the subject filaments were dried at 110° C. (relaxation heat treatment) and then cut in a fiber length of 5.0 mm. As a result of the measurement in a tow state prior to cutting, the single yarn fineness was 11.1 dtex; the strength was 1.2 cN/dtex; the elongation was 150%; the number of crimp was 11.0 per 25 mm; the percentage of crimp was 6.3%; the percentage of crimp/number of crimp was 0.57; and the dry heat shrinkage percentage at 120° C. was −4.0%. An airlaid web was manufactured from the obtained conjugate fiber and thermally adhered at 180° C. As a result, the percentage of area shrinkage of web was 0%; the tenacity of nonwoven fabric was 11.4 kg/g; and the web texture was Level 1.

EXAMPLE 15

Polyethylene terephthalate (PET) of IV=0.64 dL/g, MFR=25 g/10 min, Tg=70° C. and Tm=256° C. was used for a core component (fiber forming resin component); and a crystalline copolyester (polyethylene terephthalate having 20% by mole of isophthalic acid and 50% by mole of tetramethylene glycol copolymerized therewith; namely co-PET-2) of MFR=40 g/10 min, Tm=152° C. and Tg=43° C. was used as the sheath component (thermoadhesive resin component). These resins were molten at 290° C. and 255° C., respectively; and a concentric core/sheath type conjugate fiber was formed in a weight ratio of the core component to the sheath component of 50/50 (% by weight) by using a known nozzle for concentric core/sheath type conjugate fiber and spun under a condition at a discharge amount of 0.71 g/min/hole and at a spinning rate of 1,250 m/min, thereby obtaining an undrawn yarn. The subject undrawn yarn was drawn in a low draw ratio of 1.0 time in warm water of 90° C. which temperature was 20° C. higher than the glass transition temperature of the resin of the core component and simultaneously subjected to a fixed-length heat treatment. Subsequently, the filaments obtained by the fixed-length heat treatment were dipped in an aqueous solution of a lubricant made of a lauryl phosphate potassium salt and polyoxyethylene-modified silicone (weight ratio=80/20), and eleven mechanical crimps per 25 mm were imparted thereto by using a crimper with a stuffing box. Furthermore, the subject filaments were dried at 95° C. (relaxation heat treatment) and then cut in a fiber length of 5.0 mm. As a result of the measurement in a tow state prior to cutting, the single yarn fineness was 5.7 dtex; the strength was 1.0 cN/dtex; the elongation was 400%; the number of crimp was 11.1 per 25 mm; the percentage of crimp was 7.5%; the percentage of crimp/number of crimp was 0.68; and the dry heat shrinkage percentage at 120° C. was −3.5%. An airlaid web was manufactured from the obtained conjugate fiber and thermally adhered at 180° C. As a result, the percentage of area shrinkage of web was 0%; the strength of nonwoven fabric was 11.0 kg/g; and the web texture was Level 1.

COMPARATIVE EXAMPLE 6

Polyethylene terephthalate (PET) of IV=0.64 dL/g, MFR=25 g/10 min, Tg=70° C. and Tm=256° C. was used for a core component (fiber forming resin component); and an amorphous copolyester (polyethylene terephthalate having 30% by mole of isophthalic acid and 8% by mole of diethylene glycol copolymerized therewith; hereinafter abbreviated as "co-PET-3") of MFR=40 g/10 min and Tg=63° C. (not having a melting point) was used as the sheath component (thermoadhesive resin component). These resins were molten at 290° C. and 250° C., respectively; and a concentric core/sheath type conjugate fiber was formed in a weight ratio of the core component to the sheath component of 50/50 (% by weight) by using a known nozzle for concentric core/sheath type conjugate fiber and spun under a condition at a discharge amount of 0.71 g/min/hole and at a spinning rate of 1,250 m/min, thereby obtaining an undrawn yarn. The subject undrawn yarn was drawn in a low draw ratio of 1.0 time in warm water of 65° C. and simultaneously subjected to a fixed-length heat treatment. Subsequently, the filaments obtained by the fixed-length heat treatment were dipped in an aqueous solution of a lubricant made of a lauryl phosphate potassium salt and polyoxyethylene-modified silicone (weight ratio=80/20), and nine mechanical crimps per 25 mm were imparted thereto by using a crimper with a stuffing box. Furthermore, the subject filaments were dried at 55° C. (relaxation heat treatment) and then cut in a fiber length of 5.0 mm. As a result of the measurement in a tow state prior to cutting, the single yarn fineness was 5.7 dtex; the strength was 1.5 cN/dtex; the elongation was 180%; the number of crimp was 8.9 per 25 mm; the percentage of crimp was 9.3%; the percentage of crimp/number of crimp was 1.04; and the dry heat shrinkage percentage at 120° C. was 75%. An airlaid web was manufactured from the obtained conjugate fiber and thermally adhered at 180° C. As a result, the shrinkage of the web was so large that both the percentage of area shrinkage of web and the tenacity of nonwoven fabric could not be measured.

The thermoadhesive conjugate fiber of the invention is to improve card-passing properties which are a drawback of low orientation type thermoadhesive conjugate fibers with high adhesion and low heat shrinkability which have hitherto been proposed. Also, the thermoadhesive conjugate fiber of the invention is able to not only improve the productivity of nonwoven fabrics but also provide a thermoadhesive nonwoven fabric with satisfactory web grade. Furthermore, the thermoadhesive conjugate fiber of the invention is characterized in that the thermoadhesive conjugate fiber has self-elongation as compared with thermoadhesive conjugate fibers with high adhesion and low heat shrinkability which have hitherto been proposed. Also, in manufacturing the thermoadhesive conjugate fiber of the invention, since a process such as high-speed spinning is not required, the energy costs are low and a loss of doffing switching and yarn cutting are low so that a merit of improving the yield is large.

Accordingly, when a nonwoven fabric is manufactured by using the thermoadhesive conjugate fiber of the invention, it is possible to obtain a nonwoven fabric which is finished bulkily after thermal adhesion and is excellent in texture and high in tenacity of nonwoven fabric. Furthermore, in a nonwoven fabric using the thermoadhesive conjugate fiber of the invention, since the thermal adhesion temperature can be set up high for the purpose of increasing the adhesive strength, it is possible to produce a thermoadhesive nonwoven fabric or a fiber structure at a high speed. Also, it is possible to provide an airlaid nonwoven fabric which is high in strength of nonwoven fabric, low in heat shrinkage of nonwoven fabric and good in grade as a short fiber for airlaid nonwoven fabric.

What is claimed is:

1. A thermoadhesive conjugate fiber which is a conjugate fiber made of a fiber forming resin component and a thermoadhesive resin component, wherein the thermoadhesive resin component is made of a crystalline thermoplastic resin having a melting point of at least 20° C. lower than that of the fiber forming resin component and that the conjugate fiber has a breaking elongation of from 80 to 600% and a dry heat shrinkage percentage at 120° C. of from −10.0 to 5.0%.

2. The thermoadhesive conjugate fiber according to claim 1, wherein a percentage of crimp/number of crimp is 0.8 or more.

3. The thermoadhesive conjugate fiber according to claim 1, which is a concentric core/sheath type conjugate fiber or an eccentric core/sheath type conjugate fiber in which the fiber forming resin component is a core and the thermoadhesive resin component is a sheath.

4. The thermoadhesive conjugate fiber according to claim 3, wherein a weight ratio of the resin component constituting the core to the resin component constituting the sheath is from 60/40 to 10/90 (weight ratio).

5. The thermoadhesive conjugate fiber according to claim 1, wherein a melt flow rate (MFR) (measurement temperature: 230° C., load 21.18N polypropylene resin was measured, measurement temperature: 280° C., load 21.18N polyethylene terephthalate resin was measured, measurement temperature: 190° C., load 21.18N other resin was measured) of a major crystalline thermo-plastic resin constituting the thermo-adhesive resin component before the thermoadhesive conjugate fiber is made is from 1 to 15 g/10 mm.

6. The thermoadhesive conjugate fiber according to claim 1, wherein a melt flow rate (MFR) (measurement temperature: 230° C., load 21.18N polypropylene resin was measured, measurement temperature: 280° C., load 21.18N polyethylene terephthalate resin was measured, measurement temperature: 190° C., load 21.18N other resin was measured) of a major crystalline thermo-plastic resin constituting the thermoadhesive resin component before the thermoadhesive conjugate fiber is made is at least 5 g/10 mm smaller than MFR of the fiber forming resin component.

7. The thermoadhesive conjugate fiber according to claim 1, wherein the thermoadhesive resin component is constituted of a polymer blend made of two or more kinds of thermoplastic resins.

8. The thermoadhesive conjugate fiber according to claim 7, wherein the thermoadhesive resin component is constituted of a polymer blend made of from 100 to 60% by weight of a crystalline thermoplastic resin A and from 0 to 40% by weight of a crystalline thermoplastic resin B; and that a melting point of the crystalline thermoplastic resin B is at least 20° C. lower than a melting point of the crystalline thermoplastic resin A.

9. The thermoadhesive conjugate fiber according to claim 7, wherein the thermoadhesive resin component is constituted of a polymer blend made of from 99.8 to 90% by weight of a crystalline thermoplastic resin A and from 0.2 to 10% by weight of an amorphous thermoplastic resin; and that a glass transition temperature of the amorphous thermoplastic resin is at least 20° C. lower than a melting point of the crystalline thermoplastic resin A.

10. The thermoadhesive conjugate fiber according to claim 1, wherein the fiber forming resin composition is polyethylene terephthalate.

11. The thermoadhesive conjugate fiber according to claim 1, wherein a major crystalline thermoplastic resin of the thermoadhesive resin component is a polyolefin resin.

12. The thermoadhesive conjugate fiber according to claim 1, wherein a major crystalline thermoplastic resin of the thermoadhesive resin component is a crystalline copolyester.

13. A manufacturing method of the thermoadhesive conjugate fiber according to claim 1, which includes drawing an undrawn yarn of a conjugate fiber taken up at a spinning rate of from 150 to 1,800 m/min in a low draw ratio of from 0.5 to 1.3 times at a temperature higher than both a glass transition temperature of a major crystalline thermoplastic resin of the thermoadhesive resin component and a glass transition temperature of the fiber forming resin component and simultaneously subjecting to a fixed-length heat treatment and subsequently subjecting to a heat treatment under no tension at a temperature of at least 5° C. higher than the temperature of the fixed-length heat treatment.

14. A manufacturing method of the thermoadhesive conjugate fiber according to claim 6, which includes drawing an undrawn yarn of a conjugate fiber in which a melt flow rate of a major crystalline thermoplastic resin constituting the thermo-adhesive resin component is at least 5 g/10 mm smaller than a melt flow rate of the fiber forming resin component and which has been taken up at a spinning rate of from 150 to 1,800 m/min in a low draw ratio of from 0.5 to 1.3 times at a temperature higher than both a glass transition temperature of the major crystalline thermoplastic resin of the thermoadhesive resin component and a glass transition temperature of the fiber forming resin component and simultaneously subjecting to a fixed-length heat treatment and subsequently subjecting to a heat treatment under no tension at a temperature of at least 5° C. higher than the temperature of the fixed-length heat treatment.

15. A manufacturing method of the thermoadhesive conjugate fiber according to claim 8, which includes drawing an undrawn yarn of a conjugate fiber in which the thermoadhesive resin component is constituted of a polymer blend made of from 100 to 60% by weight of a crystalline thermoplastic resin A and from 0 to 40% by weight of a crystalline thermoplastic resin B and a melting point of the crystalline thermoplastic resin B is at least 20° C. lower than a melting point of the crystalline thermoplastic resin A and which has been taken up at a spinning rate of from 150 to 1,800 m/min in a low draw ratio of from 0.5 to 1.3 times at a temperature higher than both a glass transition temperature of the major crystalline thermoplastic resin A of the thermoadhesive resin component and a glass transition temperature of the fiber forming resin component and simultaneously subjecting to a fixed-length heat treatment and subsequently subjecting to a heat treatment under no tension at a temperature of at least 5° C. higher than the temperature of the fixed-length heat treatment.

16. A manufacturing method of the thermoadhesive conjugate fiber according to claim 9, which includes drawing an undrawn yarn of a conjugate fiber in which the thermoadhesive resin component is constituted of a polymer blend made of from 99.8 to 90% by weight of a crystalline thermoplastic resin A and from 0.2 to 10% by weight of an amorphous thermoplastic resin and a glass transition temperature of the amorphous thermoplastic resin is at least 20° C. lower than a melting point of the crystalline thermoplastic resin A and which has been taken up at a spinning rate of from 150 to 1,800 m/min in a low draw ratio of from 0.5 to 1.3 times at a temperature higher than both a glass transition temperature of the major crystalline thermoplastic resin A of the thermoadhesive resin component and a glass transition temperature of the fiber forming resin component and simultaneously subjecting to a fixed-length heat treatment and subsequently subjecting to a heat treatment under no tension at a temperature of at least 5° C. higher than the temperature of the fixed-length heat treatment.

17. The manufacturing method of the thermoadhesive conjugate fiber according to claim 13, wherein the fixed-length heat treatment is carried out in warm water; and that the heat treatment under no tension is carried out in hot air.

18. The manufacturing method of the thermoadhesive conjugate fiber according to claim 14, wherein the fixed-length heat treatment is carried out in warm water; and that the heat treatment under no tension is carried out in hot air.

19. The manufacturing method of the thermoadhesive conjugate fiber according to claim 15, wherein the fixed-length heat treatment is carried out in warm water; and that the heat treatment under no tension is carried out in hot air.

20. The manufacturing method of the thermoadhesive conjugate fiber according to claim 16, wherein the fixed-length heat treatment is carried out in warm water; and that the heat treatment under no tension is carried out in hot air.

* * * * *